US005392627A

United States Patent [19]

Benz

[11] Patent Number: 5,392,627

[45] Date of Patent: Feb. 28, 1995

[54] LEVELING MACHINE FOR METAL SHEET AND STRIP

[75] Inventor: Willi Benz, Neus, Germany

[73] Assignee: SMS Schloemann-Siemag Aktiengesellschaft, Dusseldorf, Germany

[21] Appl. No.: 141,313

[22] Filed: Oct. 22, 1993

[30] Foreign Application Priority Data

Oct. 23, 1992 [DE] Germany ..... 4235931.7

[51] Int. Cl.[6] ..... B21D 1/02; B21B 28/00

[52] U.S. Cl. ..... 72/163; 72/236

[58] Field of Search ..... 72/236, 163–165, 72/160

[56] References Cited

U.S. PATENT DOCUMENTS

| | | | |
|---|---|---|---|
| 1,094,202 | 4/1914 | Dunlop | 72/236 |
| 4,313,322 | 2/1982 | Malnowski | 72/164 |
| 4,454,738 | 6/1984 | Buta | 72/163 |

FOREIGN PATENT DOCUMENTS

| | | | |
|---|---|---|---|
| 1097 | 1/1971 | Japan | 72/163 |

*Primary Examiner*—Daniel C. Crane

*Attorney, Agent, or Firm*—Anderson Kill Olik & Oshinsky

[57] ABSTRACT

A leveling machine for metal sheet or strip with upper and lower leveling rollers offset relative to one another and supported by back-up rollers, which are located between web plates lying on adjustment wedges supported on roller blocks and cross ties, includes discharge rods reciprocating in the metal plate traveling direction and disposed between the web plates.

5 Claims, 5 Drawing Sheets

LEVELING MACHINE FOR METAL SHEET AND STRIP

BACKGROUND OF THE INVENTION

The invention relates to a leveler for metal sheet and strip with top and bottom leveling rollers offset relative to each other and supported by backup rollers which are located between web plates supported by adjusting webs which lie on roller blocks or cross ties.

In order to be able to carry away sinter or dirt from the leveling region, which unavoidably are a result of the leveling process of metal sheets and strips, the known levelers comprise slots between the web plates in great quantities in the roller blocks, which slots extend through the bottom cross ties. However large even wide slots are insufficient for preventing the sinter, which is mostly mixed with grease or oil which promotes caking, from blocking the slots. Apart from this, the slots result in an unnecessary weakening of the roller block and the cross tie, and additional shielding has to be provided since the sinter passes through all of the moving parts of the leveler.

The object of the invention is a leveling machine of the type described above which sinter disposal is assured without the above-mentioned disadvantages.

SUMMARY OF THE INVENTION

The object of the invention is achieved by disposing reciprocating discharge rods parallel to the metal sheet traveling direction between the web plates. In this way, the sinter can be discharged by the continuously to and fro slow moving rods, of which, respectively, one is disposed between two adjacent web plates which bound a closed space or discharge channel on the sides. Approximately thirty discharge rods are distributed along the width of the leveler. The sinter thus is unable to accumulate in the closed discharge channels in the metal sheet region, and since the slots for disposing of sinter or dirt can be eliminated, neither the roller blocks nor the bottom cross ties are weakened.

It is proposed that the discharge rods be located in a discharge trolley which for this purpose can advantageously comprise, at its head, a support beam for the discharge rods extending across the width of the leveler. The discharge rods can for instance be screwed in receptacles allocated for them in the support beam, or they can be detachably connected with same by a snap-in connection .

According to one embodiment of the invention, a discharge rod can consist of two steel angle irons connected with one another by steel sheets, with adjacent sheets extending at an angle to each other. In this way, a simple fabrication of the discharge rods is obtained, and the obliquely oriented steel sheet fulfills in addition to the function of connecting the steel angles, the function of removing dirt or sinter.

It is advisable that the discharge rods have an excess length or projections at their head ends. The discharge rods extended to correspond with a stroke of the discharge trolley and thus beyond the roller block region proper, can be supported due to their projections, irrespectively whether the roller block is installed or has been removed.

Furthermore, it is advisable that the discharge trolley is joined detachably to a push rod drive. Since the discharge rods must be moved out of the leveling machine in order to enable a rapid roller block replacement, as it has been stated previously, a large discharge stroke can be achieved by simply removing the push rod pivotally connected to the trolley until the trolley with the discharge rods has been put into an out-of-operation position, no longer interfering with the replacement of the roller block.

BRIEF DESCRIPTION OF THE DRAWING

The features and advantages of the invention will become apparent from the following description of the preferred embodiment when read with reference to the drawings, wherein:

FIG. 3*a* is a partial plan view of the region of the leveling machine shown in FIG. 2*a;* and FIG. 3 is a partial plan view of the trolley shown in FIG. 2*b*.

DETAILED DESCRIPTION OF THE PREFERRED EMBODIMENT

Figure 1:
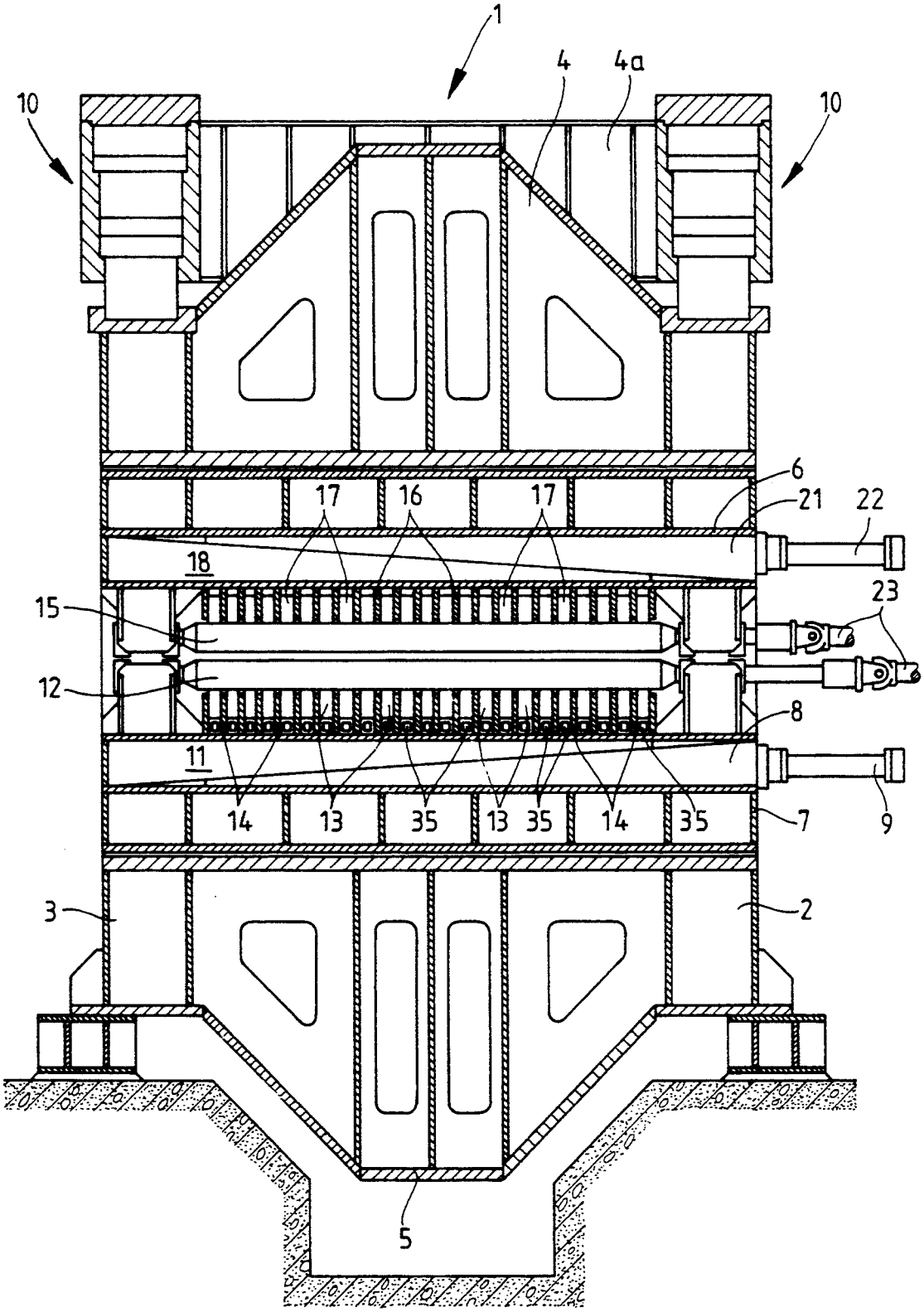
FIG. 1 is a cross-sectional view of a roller leveling machine according to the invention.

A roller leveling machine 1 comprises a machine frame consisting of two pillars 2, 3 anchored in the foundation. The pillars 2, 3 are rigidly connected with one another by an upper frame cross tie as well as by top and bottom cross ties 4, 5. An upper roller block 6 is retained at the top cross tie 4. A lower roller block 7 is displaceable on the bottom cross tie 5. The top cross tie 4 can be adjusted with respect to the bottom cross tie 5 by adjustment cylinders 10. The adjustment cylinders 10 are disposed, respectively, at inlet and outlet sides at the corners, thus the total of four adjustment cylinders 10, engage at the top cross tie 4.

Roller adjustment wedges 8 are supported on the bottom roller block 7 and can be displaced by a respective pressure cylinder 9. A support carrier wedge 11 for the bottom leveling rollers 12 and the back-up rolls 13 backing up these are allocated to each adjustment wedge 8. Web plates 14, supporting the bearings of the leveling rollers 12, are disposed between the back-up rollers 13. Furthermore, several top leveling rollers 15 are supported at their barrels by means of back-up rollers 17 located between the web plates 16. The top leveling and back-up rollers 15, 17 are supported at a bearing carrier wedge 18. Each of the adjacent bearing wedges 18 abuts an adjustment wedge 21 whose other side rests at the top roller block 6. The adjustment wedges 21 can be displaced by a respective pressure cylinder 22. The top and bottom leveling rollers 15, 12 are individually driven and are connected to a drive (not shown) by universal shafts.

Figure 2A:
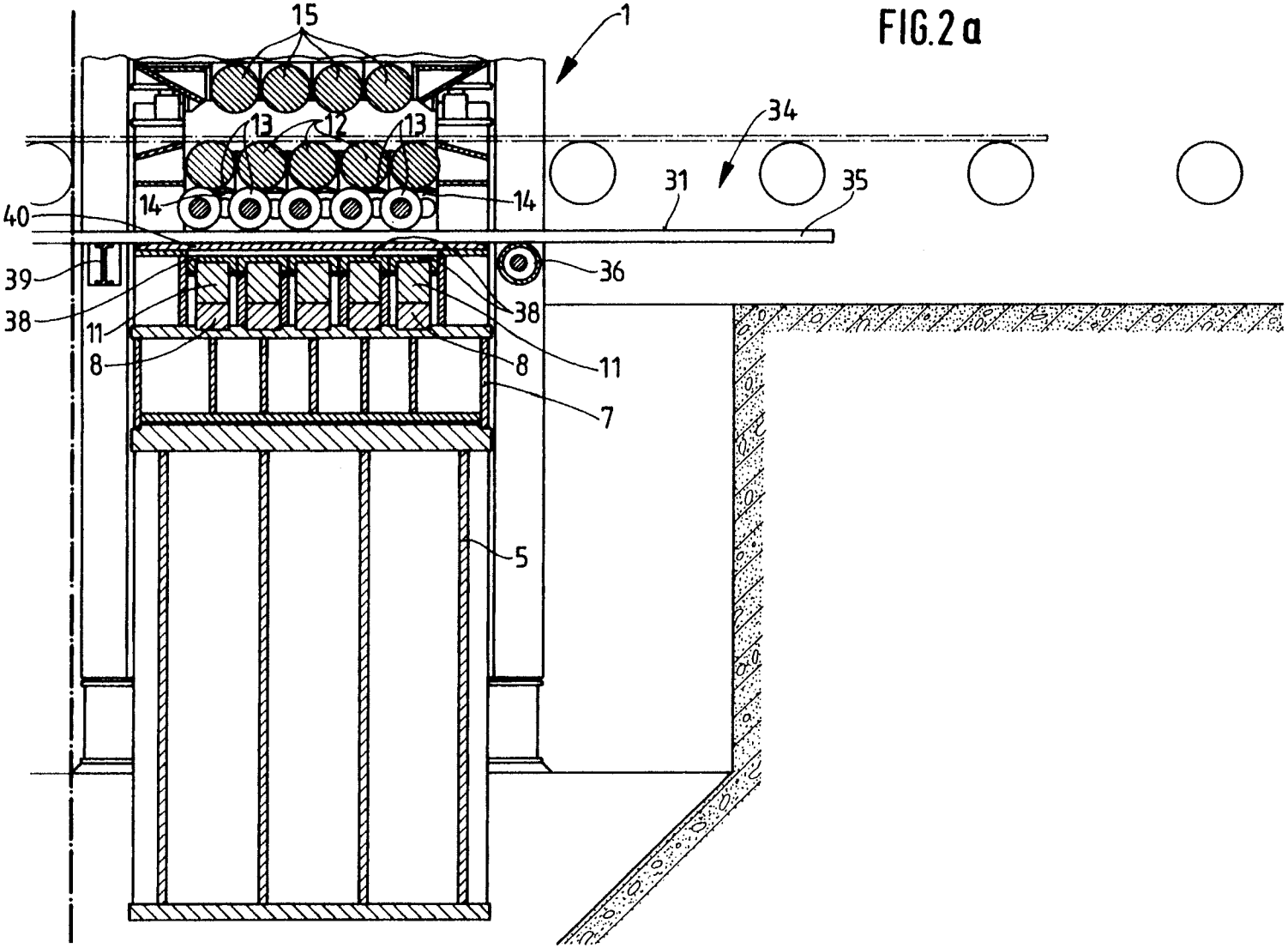
FIG. 2*a* is a partial cross-sectional longitudinal view showing the lower region of the roller leveling machine shown in FIG. 1.
Figure 2B:
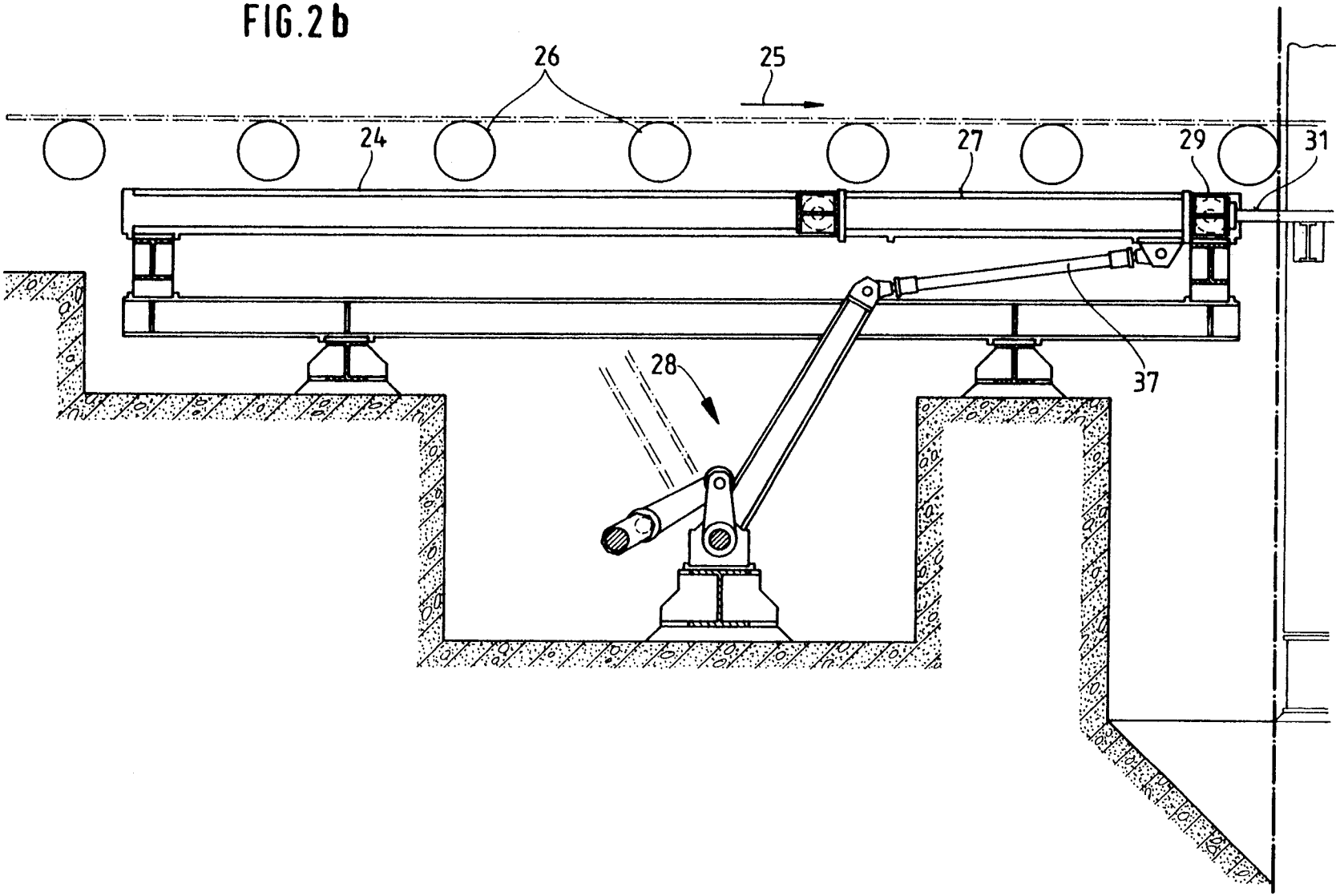
FIG. 2*b* is a view similar to that in FIG. 2*a* of a trolley which receives the sinter discharge rods and which is allocated to the inlet side of the leveling machine.
Figure 3A:
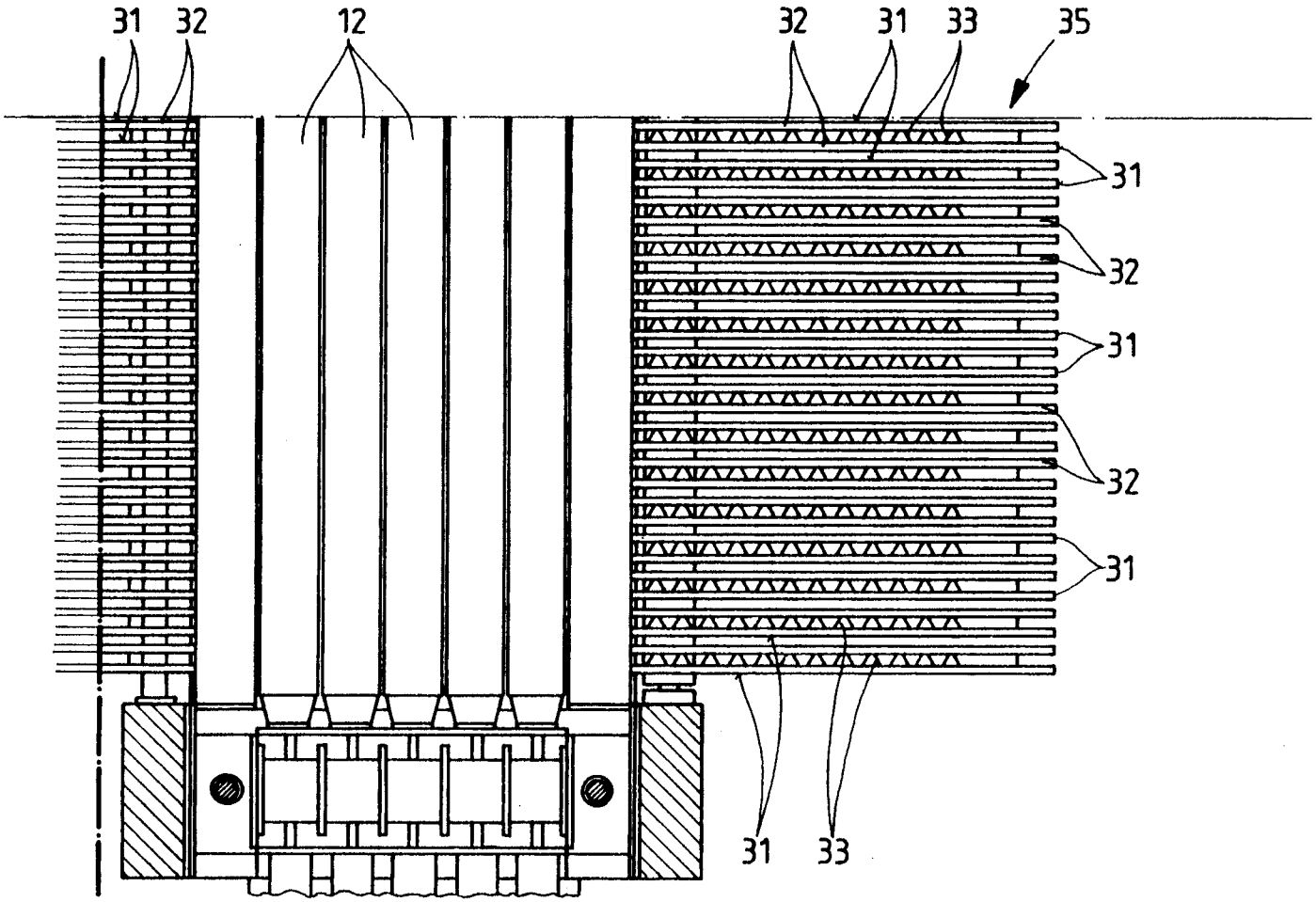
Figure 3B:
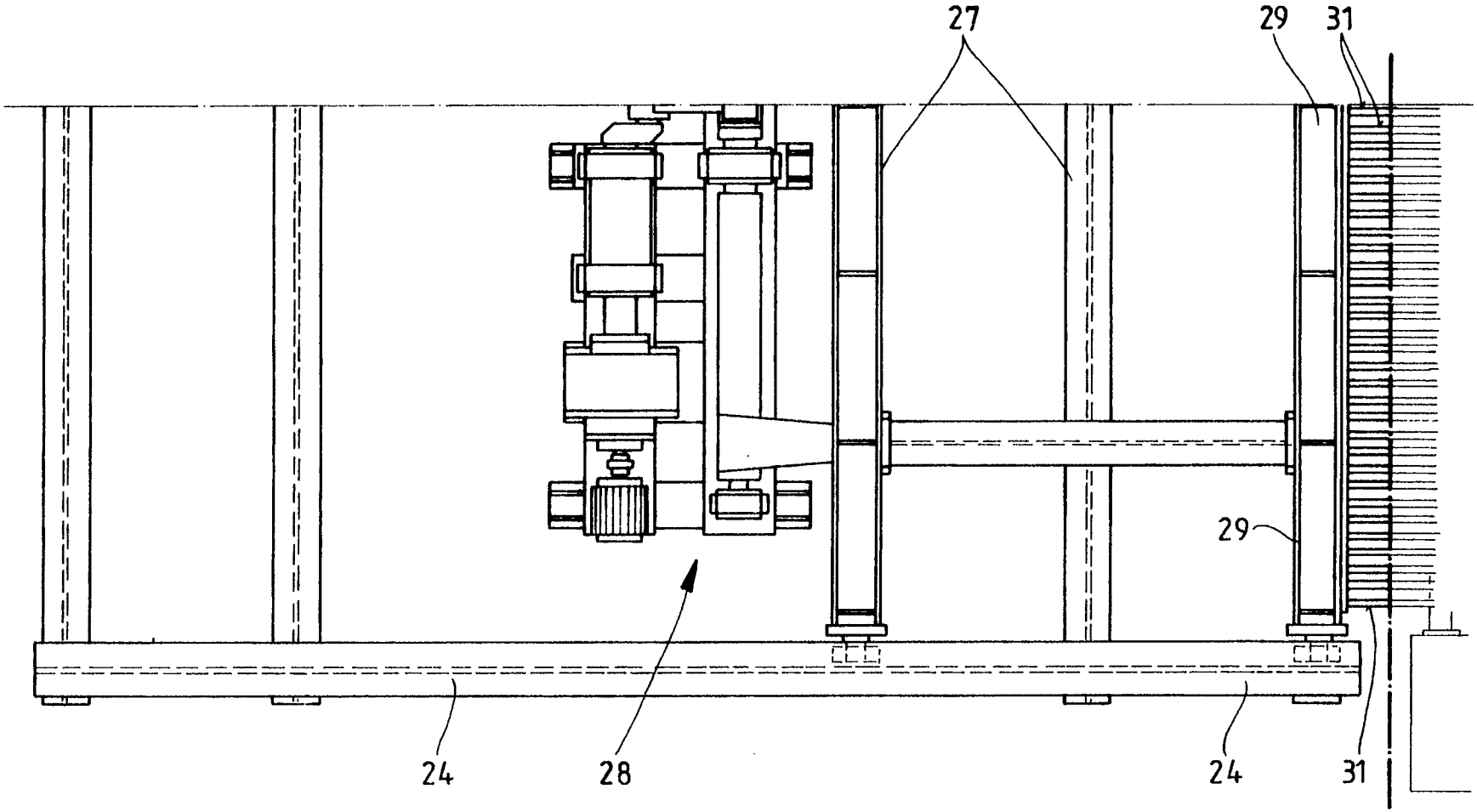

As can be seen in detail from FIGS. 2*a*, 2*b* and 3*a*, 3*b* a discharge trolley 27 for metal sheets is arranged at the entrance of the leveling machine 1 and is disposed beneath the roller table 26. The discharge trolley 27 can be continuously moved slowly to and fro in the guide 24 in the following. The discharge trolley 27 will be referred to below as simply trolley. The trolley 27 is connected to a push rod drive 28 so that it can be moved back and forth. The trolley 27 has a support or carrier beam 29 (FIG. 3*b*) extending across the entire width of the leveling machine at its end facing the leveling machine 1. The support beam 29 is provided with numerous discharge rods 31 arranged parallel to one another, which are connected with the support beam 29 at their ends facing the trolley. Each discharge rod 31 consists, as shown in FIG. *3a,* of two angle irons 32 which are connected by inclined metal sheets 33, so that a compact unit is formed. One each discharge rod 31 is disposed in a space closed at the bottom between two web plates 14 and has such a length, that it extends through the leveling machine 1 into the outlet or a discharge region 34 (see FIG. *2a*). At the head ends, the discharge rods 31 have an excess length 35, which corresponds to stroke of the trolley 27 and assures an adequate support for the discharge rod 31. With the roller block 7 installed, the discharge rods 31 abut with their excess lengths 35 a roller disposed in the discharge region 34. If the roller block 7 is removed, as is the case for replacing rollers, the discharge rods 31 must be moved out of the entire roller block region. In that case., they abut a support beam 39.

During the leveling operation, the trolley 27 is imparted a slow continuous reciprocating motion by the push rod or drive 28, so that the discharge rods 31 are continuously moved out of their rear end position, shown in FIGS. *2a* and *3a,* in the opposite direction in their end position there, and in reverse. During the stroking motion, the discharge rods 31 convey the dirt or sinter out of the leveling machine, which sinter falls from the plate or strip to be leveled and accumulates in the closed spaces between the web plates. The sinter or dirt conveyed in such a way out of the leveling machine, can be collected and conveyed away periodically or continuously, without coming into contact with the moving parts of the leveling machine 1.

In order to replace the bottom roll block 7, the discharge rods 31 are completely pulled out of the leveling machine 1 by the trolley 27, for which purpose the push rod 37 of the crank-like push-rod drive 28 articulated at the trolley 27 must merely be reversed. The initially pulling motion, as shown in FIG. *2b,* is converted into a pushing motion after the push rod 37 has been reversed and, after another reversal, it is again converted into a pulling motion. The entry of the discharge rods 31 into the channels, which are formed in the spaces between the web plates 14 and are located above the closing plate 40 and the U-shaped plate 38 enclosing the pairs of wedges 11, 8 from the top, occurs in a reverse sequence. Thus, the discharge rods 31 perform a continuous removal of sinter or dirt, for which purpose no slots resulting in unavoidable blocking and which weaken the roller block and the bottom cross-tie are required.

What is claimed is:

1. Leveling machine for metal sheet or strip, comprising:

top and bottom leveling rollers offset to one another;

back-up rollers for supporting the leveling rollers;

web plates between which said back-up rollers are arranged;

adjustment wedges for supporting said web plates;

cross ties and roller blocks for supporting said adjustment wedges;

a plurality of discharge rods reciprocating between said web plates in a sheet metal traveling direction, which is transverse to the longitudinal axes of said leveling rollers, for removing sinter and dirt out of the roller leveling machine, said discharge rods having head end projections extending into a discharge region of the leveling machine.

2. Leveling machine for metal sheet or strip, comprising:

top and bottom leveling rollers offset to one another;

back-up rollers for supporting the leveling rollers;

web plates between which said back-up rollers are arranged;

adjustment wedges for supporting said web plates;

cross ties and roller blocks for supporting said adjustment wedges;

a plurality of discharge rods reciprocating between said web plates in a sheet metal traveling direction, which is transverse to the longitudinal axes of said leveling rollers, for removing sinter and dirt out of the roller leveling machine, each discharge rod consisting of two angle irons and a plurality of plates extending between the two angle irons at an angle thereto, for connecting said two angle irons with each other.

3. Leveling machine for metal sheet or strip, comprising:

top and bottom leveling rollers offset to one another;

back-up rollers for supporting the leveling rollers;

web plates between which said back-up rollers are arranged;

adjustment wedges for supporting said web plates;

cross ties and roller blocks for supporting said adjustment wedges;

a plurality of discharge rods reciprocating between said web plates in a sheet metal traveling direction, which is transverse to the longitudinal axes of said leveling rollers, for removing sinter and dirt out of the roller leveling machine; and a discharge trolley for supporting the discharge rods.

4. A leveling machine according to claim 3, wherein the discharge trolley comprises a support beam for supporting the discharge rods and extending at its head end, across the width of the leveling machine.

5. A leveling machine according to claim 3, wherein the discharge trolley is connected detachably to a push rod drive.

* * * * *